US006201936B1

(12) United States Patent
Gross et al.

(10) Patent No.: US 6,201,936 B1
(45) Date of Patent: Mar. 13, 2001

(54) METHOD AND APPARATUS FOR ADAPTIVE BLACK SOLID AREA ESTIMATION IN A XEROGRAPHIC APPARATUS

(75) Inventors: Eric M. Gross, Rochester; Mark A. Scheuer, Williamson; Edward W. Smith, Jr., Rochester; Yao Rong Wang, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/454,421

(22) Filed: Dec. 3, 1999

(51) Int. Cl.[7] ..... G03G 15/00; G03G 15/08
(52) U.S. Cl. ..... 399/49; 399/53; 430/120
(58) Field of Search ..... 399/49, 53, 72; 324/71.1; 118/688; 430/120

(56) References Cited

U.S. PATENT DOCUMENTS

| | | | |
|---|---|---|---|
| 5,010,367 | 4/1991 | Hays | 399/266 |
| 5,162,874 | 11/1992 | Butler | 356/446 |
| 5,166,729 | 11/1992 | Rathbun et al. | 399/63 |
| 5,311,258 | 5/1994 | Brewington et al. | 399/266 |
| 5,322,970 | 6/1994 | Behe et al. | 399/279 |
| 5,386,276 | 1/1995 | Swales et al. | 399/8 |
| 5,410,388 | 4/1995 | Pacer et al. | 399/49 |
| 5,521,677 | 5/1996 | Brewington et al. | 399/59 |
| 5,581,335 | 12/1996 | Borton et al. | 399/30 |
| 5,710,958 | 1/1998 | Raj | 399/49 |
| 5,717,978 * | 2/1998 | Mestha | 399/53 X |
| 5,749,019 * | 5/1998 | Mestha | 399/49 X |
| 5,777,656 | 7/1998 | Henderson | 347/251 |
| 5,887,221 | 3/1999 | Grace | 399/49 |

* cited by examiner

*Primary Examiner*—Sophia S. Chen
(74) *Attorney, Agent, or Firm*—Fay, Sharpe, Fagan, Minnich & McKee, LLP

(57) ABSTRACT

A process control method for color quality control maintains a preselected developed mass per unit area (DMA) of black solid area by adjusting the development field during run-time operation. In order to estimate the DMA of a solid black control patch, which is outside the sensing range of an infra-red densitometer (IRD), an estimation technique is employed which accounts for system changes due to adjustment of the development field. The estimation technique includes generating two or more test patches, using a patch generator, which have DMA readings within the sensing range of the IRD. The DMA readings and corresponding development voltages of the test patches are sensed and used to calculate a developability curve. The developability curve is projected into a region beyond the sensing range of the IRD. From the developability curve, the DMA of the solid black control patch is estimated and employed in a closed feedback loop to return the system to the preselected DMA by adjusting the development field. Development field control provides faster response to toner density changes than toner concentration control, and thus, results in better color quality control.

19 Claims, 4 Drawing Sheets

METHOD AND APPARATUS FOR ADAPTIVE BLACK SOLID AREA ESTIMATION IN A XEROGRAPHIC APPARATUS

BACKGROUND OF THE INVENTION

The present invention relates to electrophotographic printing and more specifically to a method for maintaining a preselected developed mass per unit area (DMA) of black solid area in a xerographic printer by adjusting the development field of the system during run-time operation. More specifically, the invention relates to a method where the DMA of a black solid area control patch, which cannot be sensed directly using a toner density sensor, is estimated to allow for improved accuracy in the regulation of the DMA by adjusting the development field.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder, known as "toner". Toner is held on the image areas by the electrostatic charge on the photoreceptor surface. Thus, a toner image is produced in conformity with a light image of the original being reproduced. The toner image may then be transferred to a substrate or support member such as paper, and the image affixed thereto to form a permanent record of the image to be reproduced. Subsequent to development, excess toner left on the charge retentive surface is cleaned from the surface. The process is useful for light lens copying from an original document or for printing electronically generated or stored originals such as with a raster output scanner (ROS), where a charged surface may be imagewise discharged in a variety of ways.

In such electrophotographic printing, the step of conveying toner to the latent image on the photoreceptor is known as "development." The object of effective development of a latent image on the photoreceptor is to convey toner particles to the latent image in a controlled manner so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere tribolelectrically to the relatively large carrier beads, which are typically made of steel. When the developer material is placed in a magnetic field, the carrier beads with toner particles thereon form what is known as a magnetic brush, wherein the carrier beads form relatively long chains which resemble the fibers of a brush. This magnetic brush is typically created by means of a "developer roll." The developer roll is usually in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on the photoreceptor, the electrostatic charge on the photoreceptor will cause the toner particles to be pulled off the carrier beads and onto the photoreceptor.

An important variation to the general principle of development is the concept of "scavengeless" development. In a scavengeless development system, toner is detached from a donor roll by applying an AC electric field to self-spaced electrode structures, commonly in the form of wires positioned in the nip between a donor roll and photoreceptor. This forms a toner powder cloud adjacent thereto. Because there is no physical contact between the development apparatus and the photoreceptor, scavengeless development is useful for devices in which different types of toner are supplied onto the same photoreceptor such as in "tri-level", "recharge, expose and develop", "highlight", or "image on image" color xerography.

Typically, area development control is established by creating toner control patches of single desired density. Control patches are created using an alternate light source, such as a patch generator, to properly discharge the photoreceptor to the proper development field. The actual developed mass per unit area (DMA) of the toner on the control patches is then optically measured to determine the effectiveness of the printing process in placing the toner on the print sheet. Typically, a reflection infra-red densitometer is used for determining the density of the toner on a control patch. Both solid area and halftoned control patches of varying densities, including a black solid area control patch, can be used to assure color quality control. Solid patches are represented on a Solid Area Developability Curve and halftoned patches are represented on a Tone Reproduction Curve (TRC).

Direct measurement of a black solid area control patch with a reflection infra-red densitometer (IRD) is problematic in many xerographic copiers and printers. The reflection IRD is limited in the range of DMA that it can sense on a control patch. The reflection IRD cannot sense the black full developed mass of toner on a control patch when the developed mass is beyond a given limit. Typically this limit is below the black mass necessary to achieve the desired image darkness. In response to this limitation, the DMA of black solid area control patches is often estimated using a single lower density test patch created by the patch generator.

With reference to FIG. 1, a plot of DMA versus development voltage $V_{dev}$ is provided to illustrate estimation techniques of the prior art. Typically, xerographic copiers and printers are equipped with a nominal developability curve, as illustrated in FIG. 1. The nominal developability curve provides the toner density target for the system at a given development voltage. Due to environmental conditions, such as changes in humidity, and/or consumption of toner, the developability curve often changes slope from the nominal curve. For example, regular consumption of toner at a rate greater than replenishment may result in a lower toner concentration (TC), and therefore, a higher triboelectrification of the toner. This condition results in a visibly "lighter" solid black area in printed images, i.e. a lower DMA at a given development voltage. Such a condition is represented by a developability curve with a slope which is less than the slope of the nominal developability curve. Because the reflection IRD cannot sense such a change in the DMA of the solid black control patch, the DMA of the control patch must be estimated using extrapolation.

The conventional method of adjusting toner density consists of adding or removing toner from the development housing, i.e. adjusting the TC. When the TC is adjusted and the development field is held constant, the developability curve is fixed at a development onset $V_{DO}$, as shown in FIG.

1. Therefore, adjusting the toner concentration simply rotates the developability curve by changing its slope with a fixed development onset of $V_{DO}$. Because the change in DMA of the solid black area control patch cannot be sensed directly with an IRD, the DMA at the reduced TC must be estimated. The estimation technique of the prior art consists of generating a test patch using the patch generator at a DMA that is within the sensing range of the IRD. The DMA of the test patch is sensed using the IRD and the development voltage $V_{pgen}$ of the test patch is sensed using an electrostatic voltmeter (ESV). The sensed DMA reading of the test patch is then compared to the preselected DMA reading of the nominal curve at the development voltage $V_{pgen}$. From this data, the DMA of a solid black area control patch along the reduced TC developability curve is estimated. Based on the estimated DMA of the black solid area control patch, TC is adjusted to return the black solid area of the system to its preselected toner density.

Adjusting TC to correct the toner density of black solid area necessarily has a much slower response than adjusting other parameters, such as development field. Such a slow response especially adversely affects the maintenance of color quality control. Adjusting the development field in order to maintain toner density provides a much faster response. Accordingly, there is a need for a black solid area estimation technique which reliably compensates for system changes.

It is an object of the present invention to provide a new and improved method for maintaining a preselected DMA of solid black area by adjusting development field and estimating the DMA of a solid black control patch which overcomes the above-referenced problems and others.

SUMMARY OF THE INVENTION

In accordance with one aspect of the present invention, a process control method for maintaining a preselected developed mass per unit area (DMA) of black solid area in a xerographic printer includes generating a black solid area control patch and sensing the control patch voltage associated therewith. A first test patch is generated and the first DMA and first test patch development voltage are sensed. Next, a second test patch is generated and a second DMA and second test patch development voltage are sensed. A developability curve is calculated using the sensed DMA readings and sensed test patch development voltages. The developability curve is projected into a region where DMA cannot be sensed by an infra-red densitometer and the DMA of the solid black control patch is estimated. The development field of the xerographic printer is adjusted during run-time operation such that black solid area is returned to the preselected DMA.

In accordance with another aspect of the present invention, a xerographic printer which maintains a preselected DMA of black solid area by run-time adjustment of development field includes a moving photoreceptor and means for charging the photoreceptor. A projection system projects an image onto the photoreceptor. A means for generating control patches and test patches and a toner density sensor that senses the DMA of the control and test patches are also included. An electrostatic voltmeter senses the electrostatic voltages associated with the test and control patches. The xerographic printer further includes means for estimating the DMA of the black solid control patch and means for adjusting the development field during run-time operation.

In accordance with another aspect of the present invention, a xerographic printer contains an IRD with a limited sensing range and maintains the DMA of black solid area by adjusting the development field during run-time operation. The DMA of a black solid area control patch is estimated by generating a black solid area control patch and sensing its control patch voltage. Further, first and second low density test patches are generated and the respective DMA readings and test patch development voltages are sensed. From this information, a developability curve is calculated and projected into a region beyond the sensing range of the IRD. From the developability curve and the sensed control patch voltage, the estimated DMA of the black solid area control patch is calculated.

It is an object and advantage of the subject invention to provide better color quality control in xerographic printing by maintaining a preselected DMA of black solid area through adjustment of the development field during run-time operation and estimation of the DMA of black solid area control patches using at least two test patches of lower DMA. The use of multiple patches provides a better estimate of the developability curve that is affected by changes in development onset $V_{DO}$, linear slope, and higher order curvature.

BRIEF DESCRIPTION OF THE DRAWINGS

The invention may take form in various components and steps arrangements of components and steps. The drawings are only for purposes of illustrating preferred embodiments and are not to be construed as limiting the invention.

DETAILED DESCRIPTION OF THE PREFERRED EMBODIMENTS

Figure 2:
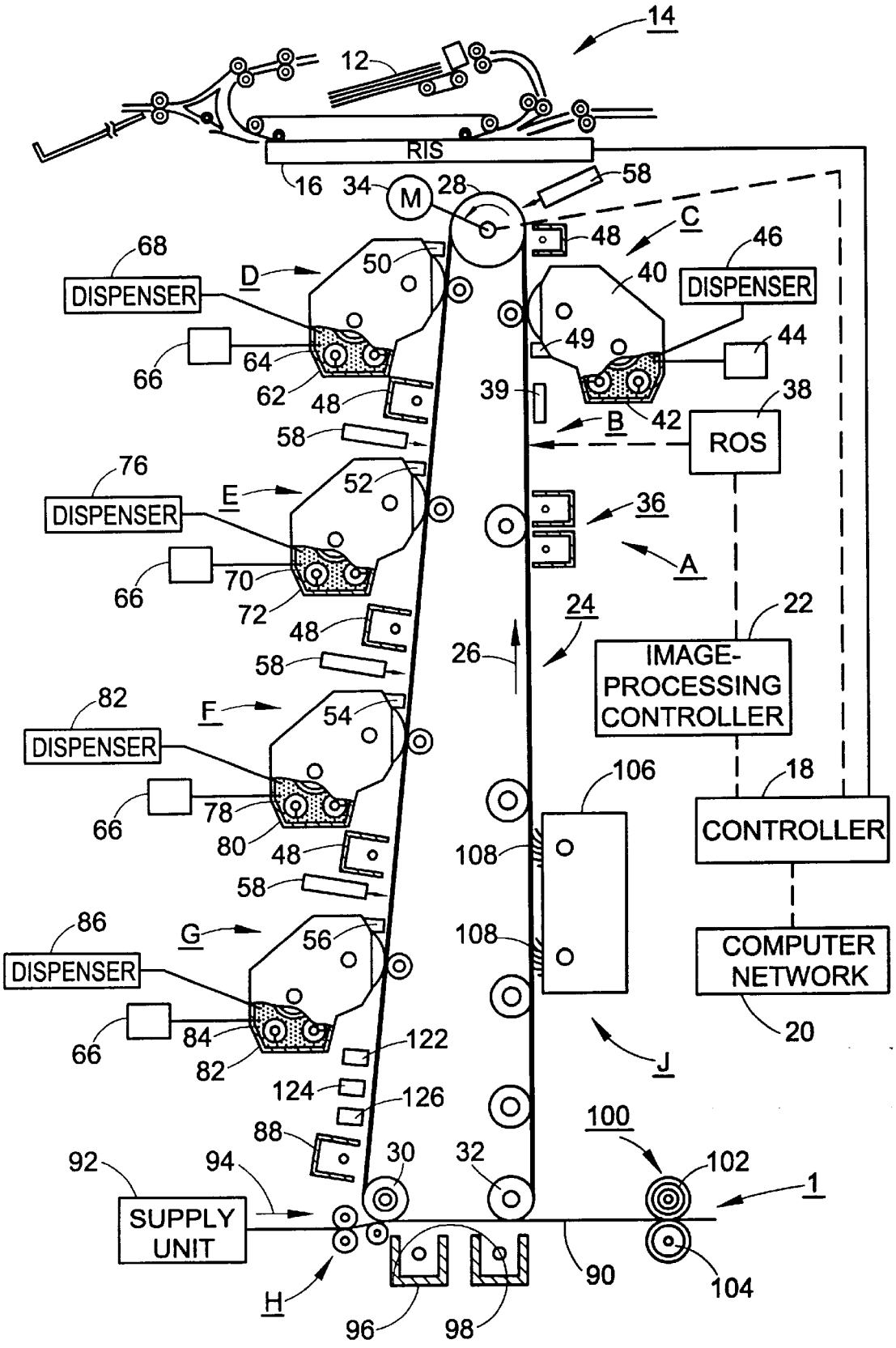
FIG. 2 is a schematic elevational view of an electrophotographic printing apparatus in which the development control of the present invention may be incorporated.

With reference to FIG. 2, in one embodiment of the invention, an original document 12 can be positioned in a document handler 14 on a Raster Input Scanner (RIS) indicated generally by reference numeral 16. However, other types of scanners may be substituted for RIS 16. The RIS 16 captures the entire original document and converts it to a series of raster scan lines or image signals. This information is transmitted to an electronic subsystem (ESS) or controller 18. Alternatively, image signals may be supplied by a computer network 20 to controller 18. An image-processing controller 22 receives the document information from the controller 18 and converts this document information into electrical signals for use by a raster output scanner.

The printing machine preferably uses a charge retentive surface in the form of a photoreceptor belt 24 supported for movement in the direction indicated by arrow 26, for advancing sequentially through various xerographic process stations. The photoreceptor belt 24 is entrained about a drive roller 28, tension roller 30, fixed roller 32. The drive roller 28 is operatively connected to a drive motor 34 for effecting movement of the photoreceptor belt 24 through the xerographic stations. In operation, as the photoreceptor belt 24 passes through charging station A, a corona generating device, indicated generally by the reference numeral 36, charges the photoconductive surface of the photoreceptor belt 24 to a relatively high, substantially uniform, preferably potential.

Next, photoconductive surface 24 is advanced through an imaging/exposure station B. As the photoreceptor passes through the imaging/exposure station B, the controller 18 receives image signals representing the desired output image from Raster Input Scanner 16 or computer network 20 and processes these signals to convert them to the various color separations of the image. The desired output image is transmitted to a laser based output scanning device, which causes the uniformly charged surface of the photoreceptor belt 24 to be discharged in accordance with the output from the scanning device. Preferably, the laser based scanning device is a laser Raster Output Scanner (ROS) 38. Alternatively, the ROS 38 could be replaced by other xerographic exposure devices such as an LED array.

The photoreceptor belt 24, which is initially charged to a voltage $V_0$, undergoes dark decay to a level equal to about −500 volts. When exposed at the exposure station B, it is discharged to a residual voltage level equal to about −50 volts. Thus, after exposure, the photoreceptor belt 24 contains a monopolar voltage profile of high and low voltages, the former corresponding to charged areas and the latter corresponding to discharged or background areas. The high voltage portions of the photoreceptor remain untoned while the low voltage portions are developed using Discharged Area Development.

A patch generator 39 in the form of a conventional exposure device utilized for such purpose is positioned after the imaging/exposure station B. It serves to create low density solid toner test patches in the interdocument zones which are used both in a developed and undeveloped condition for controlling various process functions, such as color quality control. Electrostatic voltmeters (ESV's) (described below) are utilized to sense the charge voltage of the test patches before they are developed with toner. After development (described below), a transmission or reflective toner density sensor, such as an infra-red densitometer (IRD), is utilized to sense or measure the toner density of the test patches after they have been developed.

At a first development station C where a first separation image is developed, the first development station C comprising any type of development system, including a magnetic brush development system, may be used. Preferably, a hybrid scavengeless development system including a developer structure 40 is utilized. A hybrid scavengeless development system provides the ability to develop downstream toners without scavenging toners already placed on the photoreceptor by the development of upstream image separations. As will be appreciated, the use of a scavengeless development system at the first development station is not necessary because it does not interact with an already developed image as do subsequent development structures.

Hybrid scavengeless development systems are used in development stations subsequent to station C because other developer systems would interact with a previously developed image. A hybrid scavengeless development system utilizes a standard magnetic brush development system to place charged toner on two donor rolls. A set of wires is located between the donor rolls and the photoreceptor. AC and DC fields are established on the donor and wires to create a powder cloud of toner near the photoreceptor. The frequency of the AC is set to prevent toner in the cloud from touching the photoreceptor. Instead, the image fields on the photoreceptor reach into the powder cloud and attract the toner out of the cloud. This arrangement is highly successful in preventing scavenging of developed toner images. For a more detailed description of a scavengeless development system, reference may be had to U.S. Pat. No. 5,144,371 granted to Dan Hays on Sep. 1, 1992.

The developer structure 40 contains, for example, magenta toner particles 42. The powder cloud causes charged magenta toner particles 42 to be attracted to the electrostatic latent image. Appropriate developer biasing is accomplished via a power supply (not shown). This type of development system is a hybrid scavengeless type in which only toner particles (magenta, for example) are attracted to the latent image and there is no mechanical contact between the photoreceptor belt 24 and the toner delivery device which would disturb a previously developed, but unfixed, image. A toner concentration sensor 44 senses the toner concentration in the developer structure 40. A dispenser 46 dispenses magenta toner into the developer structure 40 to maintain a proper toner concentration. The dispenser 46 is controlled via controller 18.

The developed but unfixed or non-fused image is then transported past a second charging device 48 where the photoreceptor belt 24 carrying the previously developed magenta toner image areas is recharged to a predetermined level. The charging device 48 comprises a split recharge system, wherein both a direct and an alternating current charging device, are used. While disclosed in the drawing as a single member, the split charge arrangement actually comprises separate components for effecting the DC and AC functionality. Split recharging ensures uniform charge areas on the photoreceptor, independent of previously developed toner images. The split recharge system requires that the electrostatic controls for each separation be maintained within the confines of the charge, expose, and develop steps within the image separations. For a more detailed description of a split recharge system, reference may be had to U.S. Pat. No. 5,600,430 granted on Feb. 4, 1997 to Folkins, et al.

Five separate ESVs, 49, 50, 52, 54 and 56 are employed for monitoring exposure voltages. There is one ESV for each development housing structure. Each ESV is mounted on the end of the developer housing structure with which it is associated such that it senses photoreceptor voltage prior to image development. The ESVs monitor the exposed voltages but do not directly control them. The ESV 49 is mounted on one end of the developer housing structure 40 in a position that is intermediate the ROS 38 and a developer roll forming a part of that housing structure.

A second exposure/imaging is performed by a device 58 preferably comprising a laser based output structure. The device 58 is utilized for selectively discharging the photoreceptor belt 24 on toned and/or untoned image areas of the photoreceptor 24, in accordance with the image information being processed. Device 58 maybe a Raster Output Scanner or LED bar, which is controlled by controller 18 or network computer 20. At this point, the photoreceptor belt 24 may contain toned and untoned image areas at relatively high voltage levels and toned and untoned areas at relatively low voltage levels. Low voltage areas represent image areas which are developed using Discharged Area Development (DAD) while high voltage areas remain undeveloped. A suitably charged developer material comprising the second color toner, preferably yellow, is employed. The second color toner is contained in a developer structure 62 disposed at a second developer station D and is presented to the latent electrostatic images on the photoreceptor belt 24 by way of a second developer system. A power supply (not shown) serves to electrically bias the developer structure 62 to a level effective to develop the appropriate image areas with charged yellow toner particles 64. Further, a toner concentration sensor 66 senses the toner concentration in the developer structure 62. A toner dispenser 68 dispenses yellow toner into the developer structure 62 to maintain a proper toner concentration. The dispenser 68 is controlled via controller 18.

The above procedure is repeated for a third image for a third suitable color toner such as cyan 70 contained in developer structure 72 (station E), and for a fourth image and suitable color toner such as black 78 contained in a developer structure (station F). Toner dispensers 76 and 82 serve to replenish their respective development systems.

A fifth imaging station G is provided with a developer structure 82 containing a spot toner 84 of any suitable color for use in extending the color gamut of this image processor. Toner replenishment is effected using a toner dispenser 86. Preferably, developer systems 42, 62, 72, 80 and 82 are the same or similar in structure. Also, preferably, the dispensers 46, 68, 76, 82 and 86 are the same or similar in structure.

Each of the ESVs 50, 52, 54 and 56 is positioned intermediate the ROS and the developer roll of the developer housing structure with which it is associated, as shown at the development stations.

The composite image developed on the photoreceptor belt 24 consists of negative toner particles at different voltage levels, therefore a pre-transfer corona discharge member 88 is provided to condition all of the toner to the proper voltage range for effective transfer to a substrate 90 using a corona discharge device exhibiting a predetermined discharge of the opposite polarity.

Subsequent to image development, a sheet of support material 90 is moved into contact with the toner images at transfer station H. The sheet of substrate material 90 is advanced to transfer station H from a supply unit 92 in the direction of arrow 94. The sheet of support material 90 is then brought into contact with photoconductive surface of photoreceptor belt 24 in a timed sequence so that the toner powder image developed thereon contacts the advancing sheet of support material 90 at transfer station H.

Transfer station H includes a transfer corona discharge device 96 for spraying ions onto the backside of support material 90. The polarity of these ions is opposite to the polarity of that exhibited by the pretransfer corona discharge device 88. Thus, the charged toner powder particles forming the developed images on the photoreceptor belt 24 are attracted to sheet 90. A detack dicorotron 98 is provided for facilitating stripping of the sheets from the photoreceptor belt 24 as the belt moves over the roller 32.

After transfer, the sheet of support material 90 continues to move onto a conveyor (not shown) which advances the sheet to fusing station I. Fusing station I includes a heat and pressure fuser assembly, indicated generally by the reference numeral 100, which permanently affixes the transferred powder image to sheet 90. Preferably, fuser assembly 100 comprises a heated fuser roller 102 and a backup or pressure roller 104. Sheet 90 passes between fuser roller 102 and backup roller 104 with the toner powder images contacting fuser roller 102. In this manner, the toner powder images are permanently affixed to sheet 90. After fusing, a chute, not shown, guides the advancing sheets 90 to a catch tray, stacker, finisher or other output device (not shown), for subsequent removal from the printing machine by the operator.

After the sheet of support material 90 is separated from photoconductive surface of photoreceptor belt 24, the residual toner particles remaining on the photoconductive surface after transfer are removed therefrom. These particles are removed at cleaning station using a cleaning brush or plural brush structure contained in a cleaner housing structure 106. The cleaner housing structure contains a plurality of brushes 108 which contact the photoreceptor for removal of residual toner therefrom after the toner images have been transferred to a sheet or substrate.

Controller 18 regulates the various printer functions. The controller 18 preferably includes one or more programmable controllers, which control printer functions hereinbefore described. The controller 18 may also provide a comparison count of the copy sheets, the number of documents being recirculated, the number of copy sheets selected by the operator, time delays, jam corrections, etc. The control of many of the xerographic systems heretofore described may be accomplished automatically or through the use of a user interface of the printing machine consoles selected by an operator. Conventional sheet path sensors or switches may be utilized to keep track of the position of the document and the copy sheets.

As is the case in of all print engines of the type disclosed, the photoreceptor 24 contains a plurality of Interpager Zone (IPZ) frames. IPZ refers to the space between successive toner powder images formed on the photoreceptor 24. Each IPZ contains patches to be read by the five ESVs 49, 50, 52, 54 and 56 and three enhanced toner area coverage sensors (ETACS) 122, 124 and 126. The ETACS are positioned downstream of the last developer structure 82 and upstream of the pretransfer corona device 88.

Readings made by the ETACS are converted, using an Analog to Digital converter (not shown), to digital information for use through software algorithms resident in a Master Input Output Processor MIOP (not shown). Output from the MIOP are converted to analog signal information via a Digital to Analog converter (not shown) for use in controlling the corona discharge devices 48. The use of a hierarchical control strategy isolates subsystem controls thereby enabling efficient algorithm design analysis and implementation for the algorithms forming a part of the MIOP.

Each IPZ frame is approximately 43 mm long, which is the distance required by each ROS to allow sample time for aligning the images in each xerographic module to each other (using a process referred to as rephasing). The ROS rephase process is not expected to affect the control patch image structure on a scale comparable to the ETACS or ESV field of view. The number of IPZs on the photoreceptor belt structure 24 is a function of the number of images that are be placed on the belt during one pass of the belt through all of the process stations. The number of IPZs varies form machine to machine.

The position and size of each patch in the IPZ will be established by a diagnostic timing routine during autosetup. The patches for each sensor are placed according to the field of view of each sensor, determined by the physical mounting dimensions for each sensor as well as internal dimensions for the sensing elements within each sensor. This process allows for minimum control patch sizes and, correspondingly, minimal toner waste. The ETACS patches are approximately 10 mm wide by 13 mm long (130 $mm^2$) and the ESV patches are no wider than 12 mm wide by 19 mm long (228 $mm^2$) In contrast, earlier xerographic systems use control patches of 25 mm wide and 25 mm long (625 $mm^2$).

Figure 3:
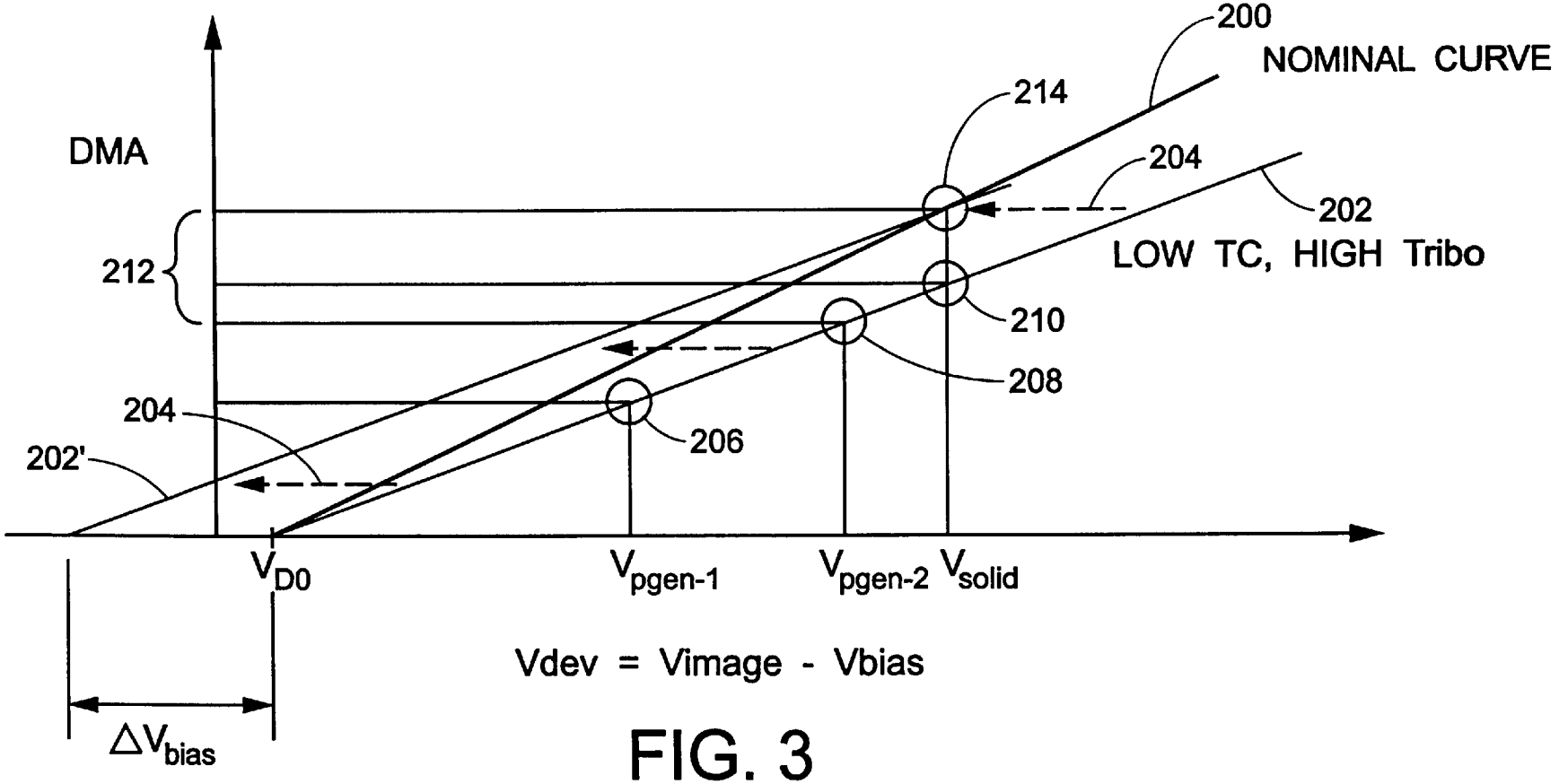
FIG. 3 is a schematic chart illustrating developability curves and estimation techniques in accordance with the present invention.

With reference to FIG. 3, a plot of developed mass per unit area (DMA) versus development voltage $V_{dev}$ is provided to illustrate a technique for estimating the DMA of black solid area control patches. The estimation technique compensates for changes in the xerographic system by adjusting the development field, rather than adjusting the toner concentration to maintain a preselected toner density. Typically, xerographic copiers and printers are designed with a nominal developability curve 200, as illustrated in FIG. 3. The nominal developability curve 200 provides the solid area density for the system at any given development voltage. FIG. 3 illustrates a developability curve 202 for a system where the toner consumption is greater than the toner replenishment. This results in a lower TC and a higher triboelectrification of the toner. A xerographic system in this state produces printed images where the solid black area is visibly lighter than desired because the DMA is lower at a given $V_{dev}$. The low TC developability curve 202 has a slope which is lower than the nominal developability curve. Alternately, a situation may exist where toner is replenished at a rate greater than the rate of consumption (not shown). This higher TC situation would be represented by a developability curve having a slope which is higher than the slope of the nominal developability curve.

Figure 1:
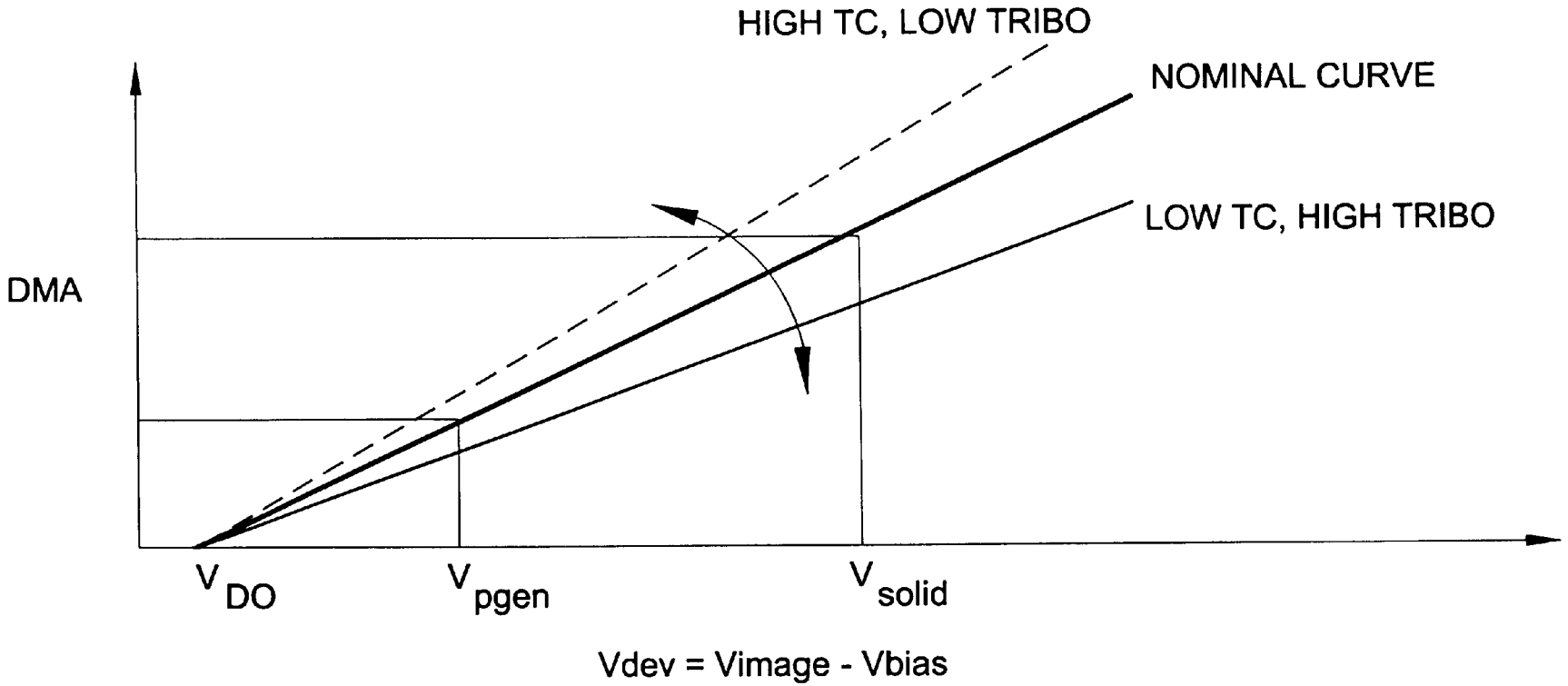
FIG. 1 (PRIOR ART)
FIG. 1 is a schematic chart illustrating developability curves and solid black area estimation techniques of the prior art.

In the present invention, a preselected DMA for black solid area is maintained by adjusting the development field during run-time operation, rather than adjusting the TC. Adjusting the development field is preferred over adjusting the TC because TC adjustment has a much slower response time. Faster response time facilitates better color quality control. In moving from TC control to development field control, the behavior of the xerographic system changes. Changing the development field results in a shifting of the developability curve 202 in the direction of arrows 204 to a new corrected position 202', rather than a rotation due to a change in slope, as shown in prior art FIG. 1. As shown in FIG. 3, the developability curve no longer has a fixed bias voltage or development onset of $V_{DO}$. Instead, a change in the development field results from a change in the bias voltage by an amount $\Delta V_{bias}$. Because the IRD cannot sense the change in DMA of the solid black control patch above certain levels, the DMA of the control patch is estimated.

Figure 4:
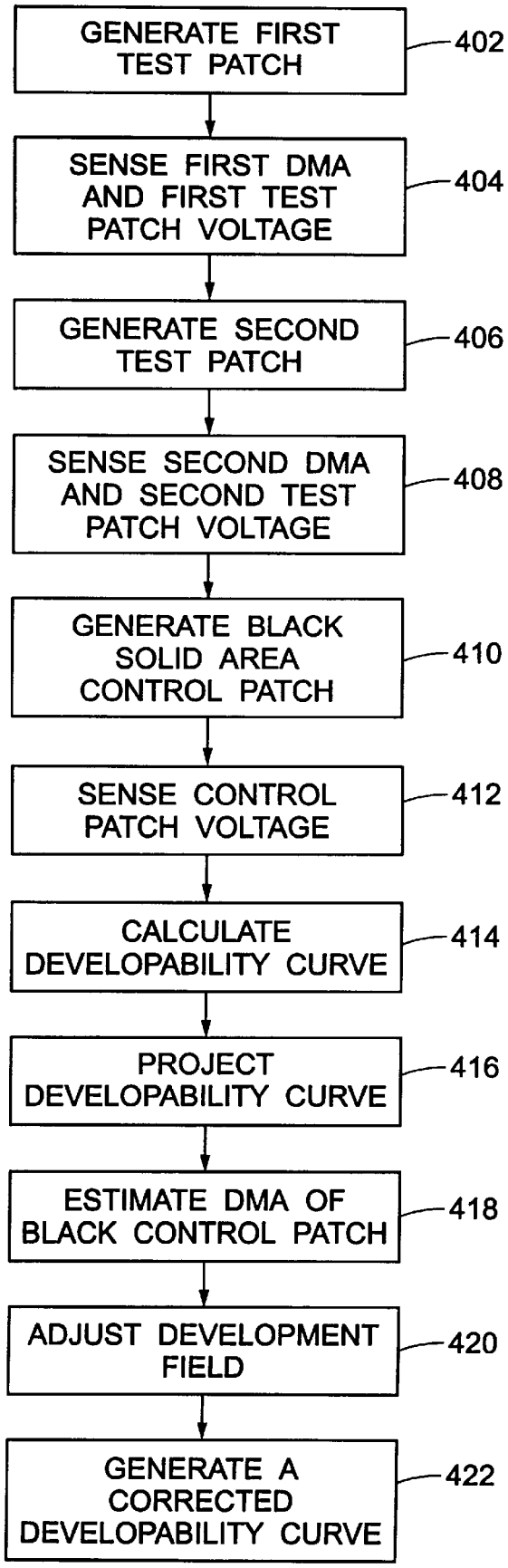
FIG. 4 is a flow diagram for maintaining a preselected DMA of black solid area in accordance with the present invention.

With reference to FIG. 4 and continued reference to FIG. 3, in order to account for the shift of the developability curve to the corrected position 202' due to adjusting the development field, estimation of the DMA of the solid black control patch requires generating at least two test patches, with each test patch having a DMA that is within the limited sensing range of the IRD. A first test patch 206 is generated 402 by the patch generator. The DMA of this test patch $DMA_1$ is sensed using the IRD and the first test patch voltage $V_{pgen1}$ is sensed 404 using an ESV. Similarly, a second test patch 208 is generated 406 using the patch generator. Again, the DMA of the second test patch $DMA_2$ is sensed using the IRD and the corresponding second test patch voltage $V_{pgen2}$ is sensed 408 by the ESV. Next, a black solid area control patch 210 is generated 410 having a development voltage $V_{solid}$. The control patch voltage $V_{solid}$ is sensed 412 with the ESV. It is to be appreciated that black DMAs in the range of the black DMA target 210 cannot be sensed by the sensor because its toner density is beyond the useful sensing range of the sensor.

From the sensed DMA readings and test patch voltages, the developability curve 202 is estimated 414. The developability curve 202 represents the actual state of the system at that given time. Using a linear fit for the developability curve (a nonlinear fit is also possible), the slope Q and the intercept R are calculated using:

$$DMA=QV_{dev}+R, \tag{1}$$

where $V_{dev}=V_{image}-V_{bias}$.

The developability curve slope is $$Q=[DMA_1-DMA_2]/[V_{pgen1}-V_{pgen2}] \tag{2}$$

and the intercept is $$R=[DMA_2V_{pgen1}-DMA_1V_{pgen2}]/[V_{pgen1}-V_{pgen2}]. \tag{3}$$

By projecting 416 the calculated developability curve 202 into the region where the IRD cannot sense DMA effectively 212, the DMA of the black solid area control patch 210 is estimated 418 using the calculated values of slope Q and intercept R as follows:

$$DMA_{est}=Q[V_{solid}-V_{bias}]+R \tag{4}$$

Once the DMA of the solid black control patch $DMA_{est}$ is estimated 418, the development field is adjusted 420 during run-time operation in a closed feedback loop in order to return $DMA_{est}$ to the target DMA for solid black area at point 214 on the nominal developability curve 200. The development field is adjusted by changing the bias voltage $V_{bias}$ by an amount $\Delta V_{bias}$ in order to shift the developability curve 202 to the corrected position 202'. The size of $\Delta V_{bias}$ which is necessary to shift the 202 curve to the corrected position 202' is determined by calculating $V_{bias}$ from equation (1) with Q, R, $V_{solid}$, and the DMA at point 214, $DMA_{solid}$, known. From this, a corrected developability curve 202' is generated 422. The xerographic system then operates on the corrected developability curve 202' This corrected developability curve 202' contains the preselected point 214 corresponding to 100% toner density, i.e., solid black area. The patch generator intensities of the first test patch 206 and the second test patch 208 can be adjusted using ESV readings and closed loop feedback control to maintain $(V_{pgen1}-V_{bias})$ and $(V_{pgen2}-V_{bias})$ as $V_{bias}$ is altered to insure that the test patches are developed within the sensing range of the IRD.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A process control method for maintaining a preselected developed mass per unit area (DMA) of black solid area in a xerographic printer, the method comprising:

generating a first test patch having a first DMA and a first test patch voltage;

sensing said first DMA and said first test patch voltage;

generating a second test patch having a second DMA and a second test patch voltage;

sensing said second DMA and said second test patch voltage;

generating a black solid area control patch and sensing the control patch voltage associated therewith;

calculating a developability curve from the sensed DMA readings and the sensed test patch voltages;

projecting said developability curve into a region where DMA cannot be sensed by a toner density sensor;

estimating the DMA of the black solid area control patch using the projected developability curve and the sensed control patch voltage;

comparing the estimated DMA with the preselected DMA; and adjusting a development field of the xerographic printer during run-time operation such that black solid area is returned to the preselected DMA.

2. The method according to claim 1, said method further comprising:

shifting the calculated developability curve into a corrected position.

3. The method according to claim 2, said method further comprising:

operating the xerographic printer on the corrected developability curve.

4. The method according to claim 1, wherein adjusting the development field includes adjusting a development bias voltage.

5. The method according to claim 4, wherein the development bias voltage adjustment is calculated based on the preselected DMA for black solid area, a slope of the developability curve, and its intercept.

6. The method according to claim 4, wherein the DMA of at least one of the first test patch and the second test patch is adjusted using closed loop feedback control as the development bias voltage is adjusted.

7. The method according to claim 1, wherein the DMA readings of the control patch and the first and second test patches are sensed using an infra-red densitometer (IRD) having a limited sensing range.

8. The method according to claim 7, wherein the DMA of the second test patch is within the limited sensing range of the IRD.

9. The method according to claim 8, wherein the DMA of the first test patch is lower than the DMA of the second test patch.

10. A xerographic printer wherein a preselected developed mass per unit area (DMA) of black solid area is maintained by run-time adjustment of development field, the xerographic printer including:

a moving photoreceptor;

means for charging the photoreceptor;

a projection system for projecting an image onto the photoreceptor;

a means for generating control patches and test patches;

a toner density sensor having a limited DMA sensing range for sensing DMA of the generated control patches and test patches;

at least one electrostatic voltmeter (ESV) for sensing electrostatic voltages associated with said control patches and test patches;

means for estimating DMA of a black solid area control patch, where said DMA is beyond the sensing range of the toner density sensor, said estimating means including:

a processor for calculating a developability curve and projecting the developability curve into a region beyond the sensing range of the toner density sensor;

means for adjusting the development field during run-time operation;

means for shifting the developability curve into a corrected position, creating a corrected developability curve; and means for operating the xerographic printer on the corrected developability curve.

11. The xerogaphic printer according to claim 10, wherein the control patches and test patches generated by a patch generator are disposed on the photoreceptor.

12. The xerographic printer according to claim 10, wherein the xerographic printer includes:

means for comparing the estimated DMA of the black solid area control patch with a predetermined black solid area DMA standard.

13. The xerographic printer according to claim 12, wherein the development field is adjusted by changing a development bias voltage in order to return the estimated DMA of the black solid area control patch to the predetermined black solid area DMA standard.

14. In a xerographic printer containing a toner density sensor with a limited sensing range, where developed mass per unit area (DMA) of black solid area is maintained by adjusting development field during run-time operation, a method for estimating the DMA of a black solid area control patch which is beyond the limited sensing range of the toner density sensor, said method including:

generating a black solid area control patch and sensing a control patch voltage associated therewith;

generating a first test patch having a first DMA and a first test patch voltage;

sensing said first DMA a said first test patch voltage;

generating a second test patch having a second DMA and a second test patch voltage;

sensing said second DMA and said second test patch voltage;

calculating a developability curve from the sensed DMA readings and the sensed first and second patch voltages;

projecting said developability curve into a region which is beyond the sensing range of the toner density sensor; and calculating the estimated DMA of the black solid area control patch using the projected developability curve and the sensed control patch voltage.

15. A xerographic printer which employs the estimation method of claim 14, said printer adjusting a development bias voltage based on the estimated DMA of the black solid area control patch in order to regulate the DMA of black solid area.

16. The xerographic printer according to claim 15, said printer operating on the projected developability curve.

17. The method according to claim 14, wherein the DMA of the control patch is outside the limited sensing range of the toner density sensor.

18. The method according to claim 14, wherein the DMA of the second test patch is within the limited sensing range of the toner density sensor.

19. The method according to claim 18, wherein the DMA of the first test patch is lower than the DMA of the second test patch.

* * * * *